US007774907B2

(12) United States Patent
Rosato et al.

(10) Patent No.: US 7,774,907 B2
(45) Date of Patent: Aug. 17, 2010

(54) CASKET MADE OF MECHANICAL PULP BOARD OR OF A SIMILAR MATERIAL WITH A SIDE ENTRANCE

(75) Inventors: Isabelle Rosato, Luneville (FR); Guy Lambert, Nancy (FR)

(73) Assignee: Rolavie, Luneville (FR)

( * ) Notice: Subject to any disclaimer, the term of this patent is extended or adjusted under 35 U.S.C. 154(b) by 0 days.

(21) Appl. No.: 11/915,730

(22) PCT Filed: May 22, 2006

(86) PCT No.: PCT/FR2006/001156

§ 371 (c)(1),
(2), (4) Date: Jun. 11, 2008

(87) PCT Pub. No.: WO2006/131614

PCT Pub. Date: Dec. 14, 2006

(65) Prior Publication Data

US 2009/0172931 A1 Jul. 9, 2009

(30) Foreign Application Priority Data

Jun. 6, 2005 (FR) ..... 05 05686

(51) Int. Cl.
*A61G 17/00* (2006.01)

(52) U.S. Cl. ..... 27/4; 27/19

(58) Field of Classification Search ..... 27/4, 27/2, 19, 35; 229/122, 117.28, 117.3; 220/23.87, 220/495.05
See application file for complete search history.

(56) References Cited

U.S. PATENT DOCUMENTS

| | | | | |
|---|---|---|---|---|
| 560,253 | A * | 5/1896 | Blackford et al. | 27/4 |
| 604,334 | A * | 5/1898 | Myers | 27/4 |
| 614,051 | A * | 11/1898 | Hammel | 27/4 |
| 658,261 | A * | 9/1900 | Herbold | 27/4 |
| 706,398 | A * | 8/1902 | Ernst | 27/4 |
| 780,468 | A * | 1/1905 | Anderson et al. | 27/4 |
| 843,157 | A * | 2/1907 | Lawson | 27/4 |
| 876,031 | A * | 1/1908 | Watt et al. | 27/4 |
| 3,969,798 | A * | 7/1976 | Sahlin | 27/4 |
| 4,177,543 | A * | 12/1979 | Angermann | 27/35 |
| 5,623,752 | A * | 4/1997 | Gillard et al. | 27/2 |
| 5,815,898 | A * | 10/1998 | Jenkins | 27/4 |
| 6,145,175 | A * | 11/2000 | Enneking et al. | 27/4 |
| 6,154,937 | A * | 12/2000 | Enneking et al. | 27/2 |
| 6,684,467 | B1 * | 2/2004 | Walker | 27/35 |
| 7,204,003 | B2 * | 4/2007 | Davis et al. | 27/2 |
| 7,213,312 | B2 * | 5/2007 | Foroni | 27/4 |
| 7,302,743 | B2 * | 12/2007 | Fash | 27/4 |
| 7,322,079 | B2 * | 1/2008 | Davis et al. | 27/19 |
| 7,350,278 | B2 * | 4/2008 | Davis et al. | 27/35 |
| 2005/0050701 | A1 | 3/2005 | Davis et al. | |

FOREIGN PATENT DOCUMENTS

| | | |
|---|---|---|
| DE | 2402470 | 7/1974 |
| DE | 29701237 | 6/1997 |
| DE | 29701237 U1 * | 6/1997 |
| WO | WO 95/08973 | 4/1995 |

* cited by examiner

*Primary Examiner*—William L. Miller
(74) *Attorney, Agent, or Firm*—Egbert Law Offices PLLC

(57) ABSTRACT

A folding casket is cut from a sheet of a rigid material, such as cardboard or wood. The bottom, the top, and at least two of the four sides of the casket are produced as a single uninterrupted blank.

6 Claims, 9 Drawing Sheets

Fig 1c
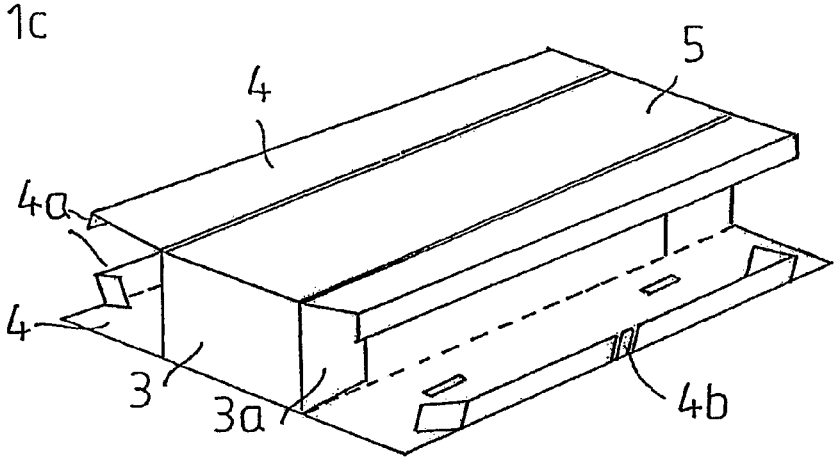
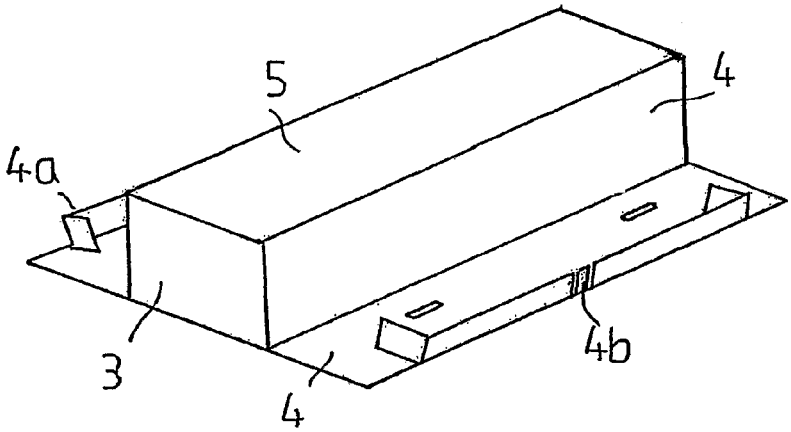
Fig 1d
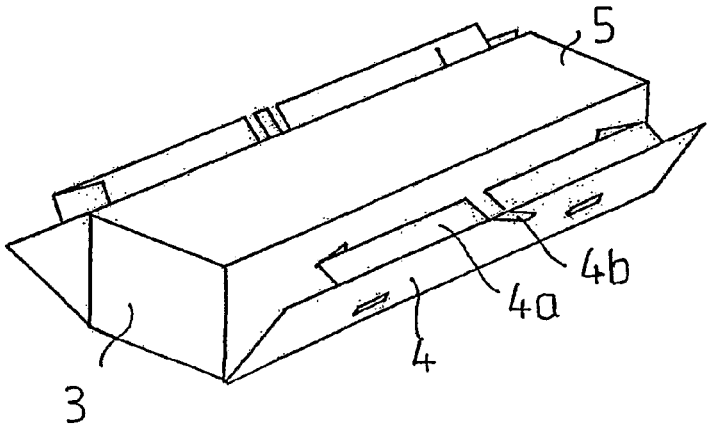
Fig 1e

CASKET MADE OF MECHANICAL PULP BOARD OR OF A SIMILAR MATERIAL WITH A SIDE ENTRANCE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a folding casket made of cardboard, wood or any other similar material, allowing lateral insertion of the deceased's body.

2. Description of Related Art Including Information Disclosed Under 37 CFR 1.97 and 37 CFR 1.98.

The prior art already provides folding caskets, usually with a top or lid independent of the body of the casket. For example, U.S. Pat. No. 5,035,032 describes a folding coffin consisting of two separate parts, the body of the coffin and its top or lid each being made by folding a different sheet.

The problem with that type of casket, both in manufacture, storage and delivery, is notably that it takes up more space and takes longer to erect, erection also requiring the use of special tools.

To overcome these disadvantages, certain caskets have a cover that is an integral part of the body of the casket.

For example, patent EP 0 680 308 describes a folding casket produced as a single uninterrupted blank from a sheet of cellulose material. The top is produced by folding some of the panels of the sheet in such a way that the top is the last part of the casket to be folded.

However, with that type of casket the deceased's body has to be inserted through the top of the casket, a task which takes several people to carry out and even so is awkward and fraught with danger.

BRIEF SUMMARY OF THE INVENTION

It is an object of the invention to overcome the various problems of the prior art by providing a folding casket produced from a single uninterrupted blank, that is with the body and top directly attached, without the addition of separate parts, from a rigid material such as cardboard, wood or any other similar material, allowing easy insertion of the body of the deceased, yet taking up little space, being easy to transport, and being quick and easy to erect, without special tools.

To this end, the subject of the present invention is a folding casket cut from a sheet of a rigid material such as cardboard or wood, characterized in that the bottom, the top and at least two of the four sides of said casket are produced as a single uninterrupted blank, and in that the casket is closed by folding one of the sides of said casket.

The casket according to the invention is produced by first cutting and then folding a sheet of rigid material. In this one sheet are included the bottom, the top and at least two of the sides of the casket, so that these various parts of the casket are attached directly to each other.

A holding tray is inserted through one of the sides of the casket when it is being folded in order to facilitate the insertion of the body and prevent body fluids draining directly into the casket. This tray is inserted without the body into the casket, after folding its two transverse sides. The deceased's body is then placed on the tray, after which the two lateral sides are folded up.

BRIEF DESCRIPTION OF THE SEVERAL VIEWS OF THE DRAWINGS

The invention will be understood more clearly by referring to the accompanying drawings.

FIGS. 1*c*, 1*d* and 1*e* show perspective views of the various stages in the folding of the casket.

DETAILED DESCRIPTION OF THE INVENTION

Figure 1A:
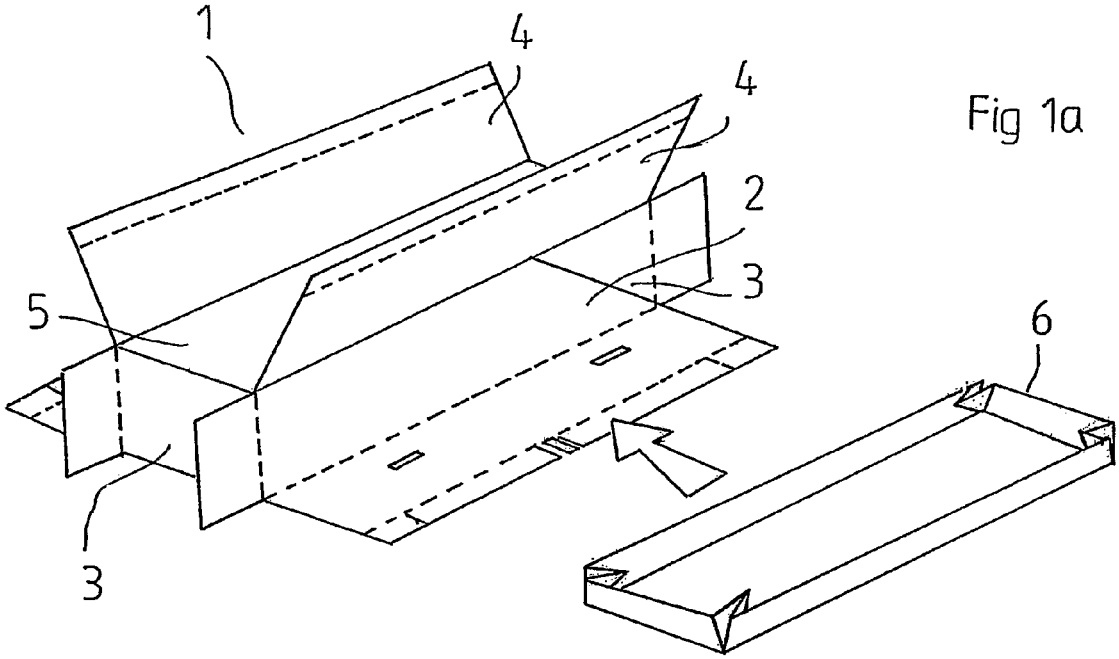
FIG. 1*a* shows a perspective view of one of the variants of the invention before the side walls are folded.
Figure 1B:
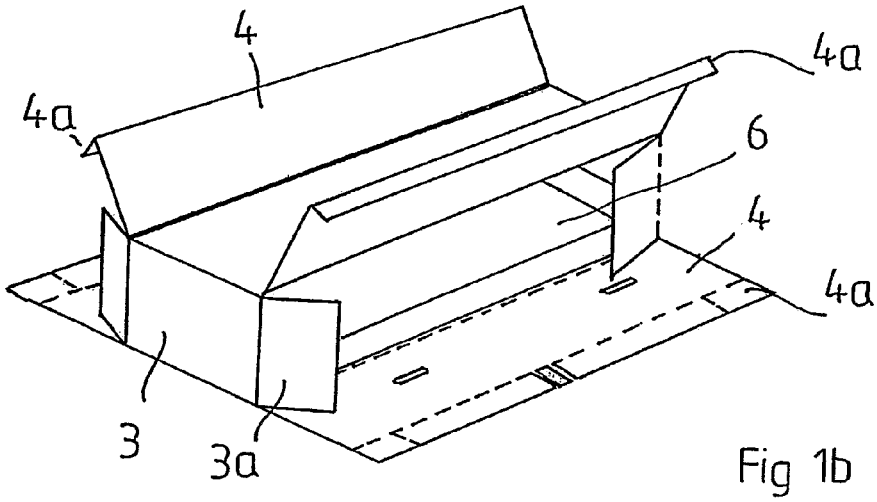
FIG. 1*b* shows another perspective view of the casket after insertion of the holding tray.
Figure 1F:
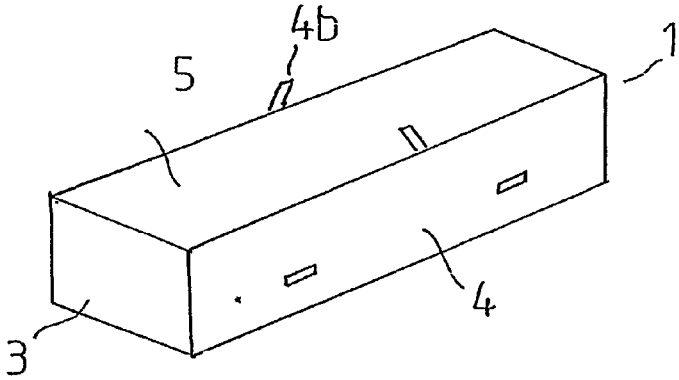
FIG. 1*f* shows a perspective view of the casket closed.

Whatever the particular form of the casket 1, it is produced from at least one sheet 1 that includes at least the bottom 2 of the casket on which the deceased's body rests on the holding tray 1, the top 5, and at least two of the four sides 3 or 4 of the casket 1, in such a way that these various parts of the casket can interlock with each other without other means of securing them.

In the first variant shown in FIGS. 1*a*-1*g*, the casket 1 has a bottom 2 connected to a top 5 by two intermediate transverse sides 3. These various parts of the casket are made by first cutting then folding a single sheet.

The sheet 1 has transverse sides 3. One of these sides is located between the bottom 2 and the top 5 in such a way as to connect these parts of the casket together. The end of the bottom 2 and the end of the top 5 also both have a transverse side 3, and these transverse sides will be superposed during erection in order to increase the rigidity of the whole.

The transverse side 3 between the bottom 2 and the top 5, as well as one of the two sides either at the end of the bottom 2 or of the top 5, have reinforcements 3*a* designed to keep the longitudinal sides 4 in position and reinforce the casket, as when closed, and allow it to support heavy weights.

The bottom 2 and the top 5 each have two longitudinal sides 4. When erected, these sides will be superposed and will thus increase the rigidity of the casket 1. These longitudinal sides 4 have longitudinal reinforcements 4*a* which will be folded during casket erection and are designed to insert into the different components of the casket 1.

Two of these longitudinal reinforcements 4*a*, either level with the bottom 2 or level with the top 5, have a tab 4*b* for opening the casket once it is closed.

Holes may be cut in the longitudinal sides 4 for use as handles to assist with carrying the casket.

The casket is erected in the following manner. The sheet 1 is folded in such a way that the top 5 is above the bottom 2 supported by the two transverse sides 3. If a supplementary transverse side 3 is added to the sheet 1, it will be superposed. The holding tray 6 is slid through one of the sides 3 or 4 of the casket, after first folding up the transverse sides of the tray. The body is then laid on the tray 6, and the tray's longitudinal sides are then folded up. The variant in FIG. 1 allows longitudinal lateral insertion of the holding tray 6.

The reinforcements 3*a* are then folded round onto the longitudinal sides 4*a*. The reinforcements 4*a* are also folded. The longitudinal sides 4 directly connected to the top 5 are folded in such a way as to give an initial closure of the casket 1. Then the other longitudinal sides 4 connected to the bottom 2 of the casket 1 are folded up to reinforce the closure of the casket 1. As these last longitudinal sides are being folded up, the tabs 4*b* are extracted from the reinforcements 4*a*.

In light of the description, it will be clear that the sheet 1 forming the main components of the casket may be different in the shape or in the disposition of the reinforcements.

Figure 2A:
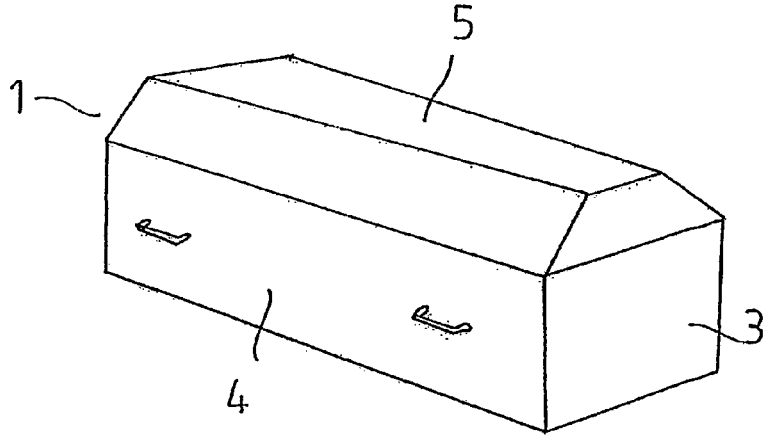
FIGS. 2*a*, 2*b* and 2*c* show perspective views of a second variant of the casket in a definitive version prior to being closed, in two types.
Figure 2B:
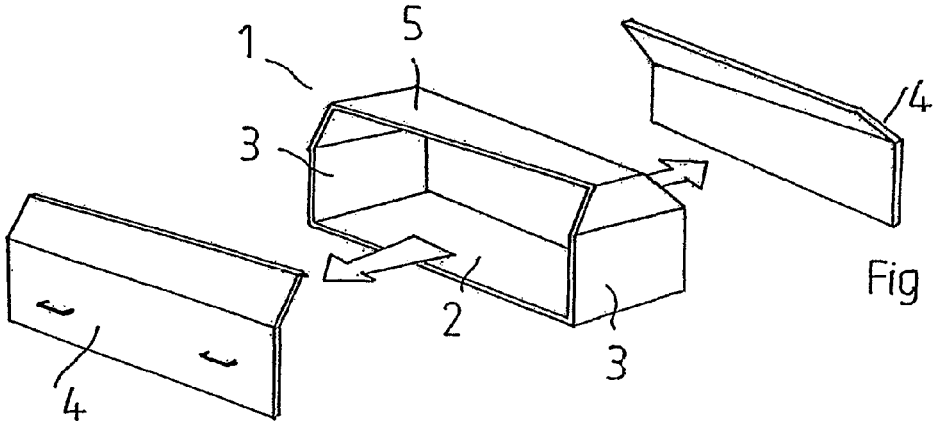
Figure 1G:
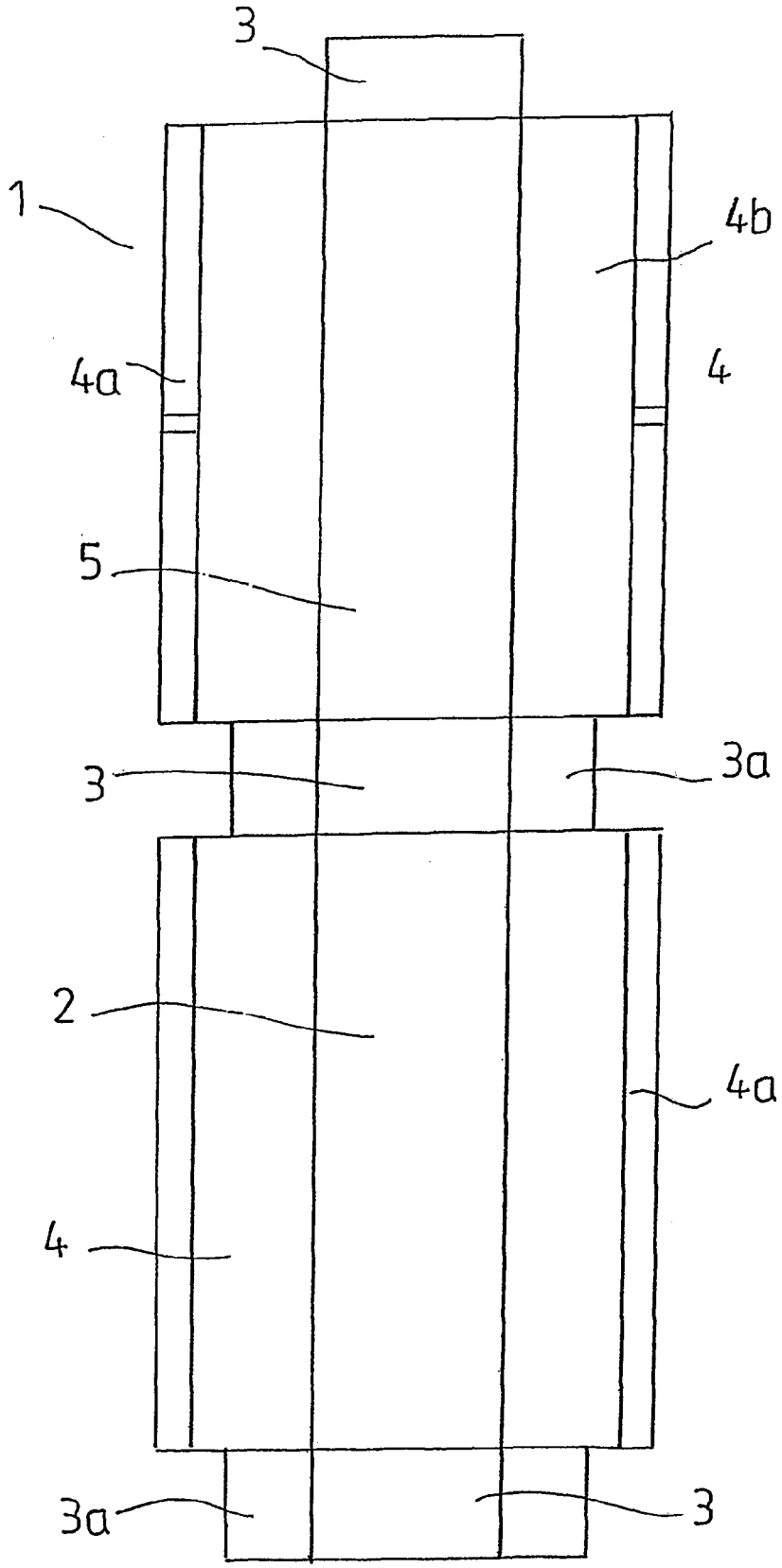
FIG. 1*g* shows a schematic view of the casket before it is folded, in sheet form.
Figure 2C:
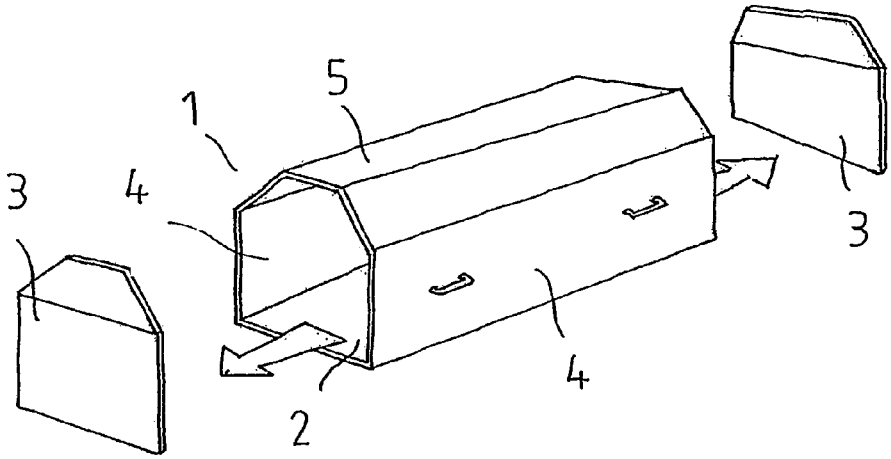

In the second variant of the casket 1 according to the invention, as shown in FIGS. 2*a*, 2*b* and 2*c*, the casket 1 is a more complicated shape. The bottom 2, the top 5 and two of the sides (the transverse sides 3 in FIG. 2*ba*; the longitudinal sides 4 in FIG. 2*c*) are produced as a single uninterrupted blank. The missing sides, namely the longitudinal sides 4 in FIG. 2*b* and the transverse sides in FIG. 2*c*, are then added to close the casket, following insertion of the holding tray (which is not shown).

Figure 3A:
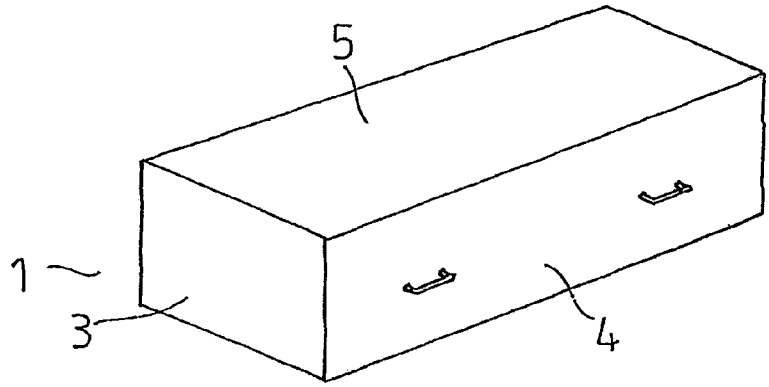
FIGS. 3*a*, 3*b* and 3*c* show perspective views of a third variant after closure, and before its two types of closure.
Figure 3B:
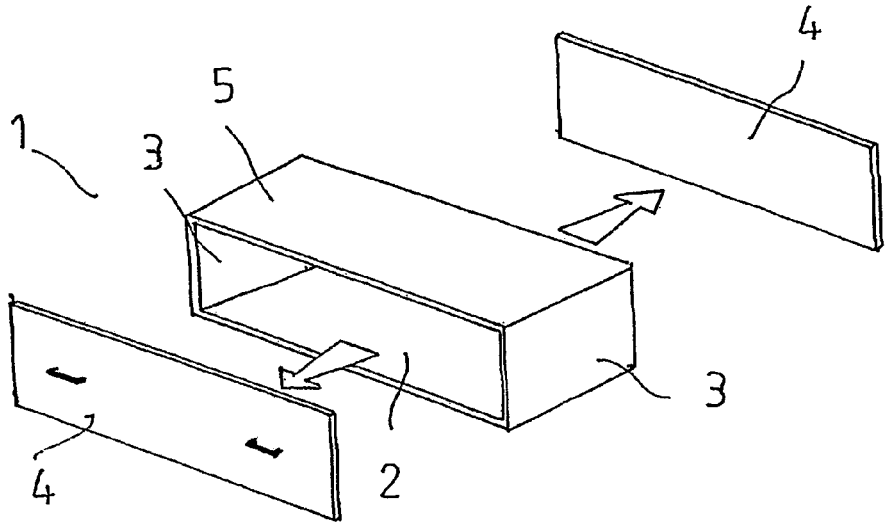
Figure 3C:
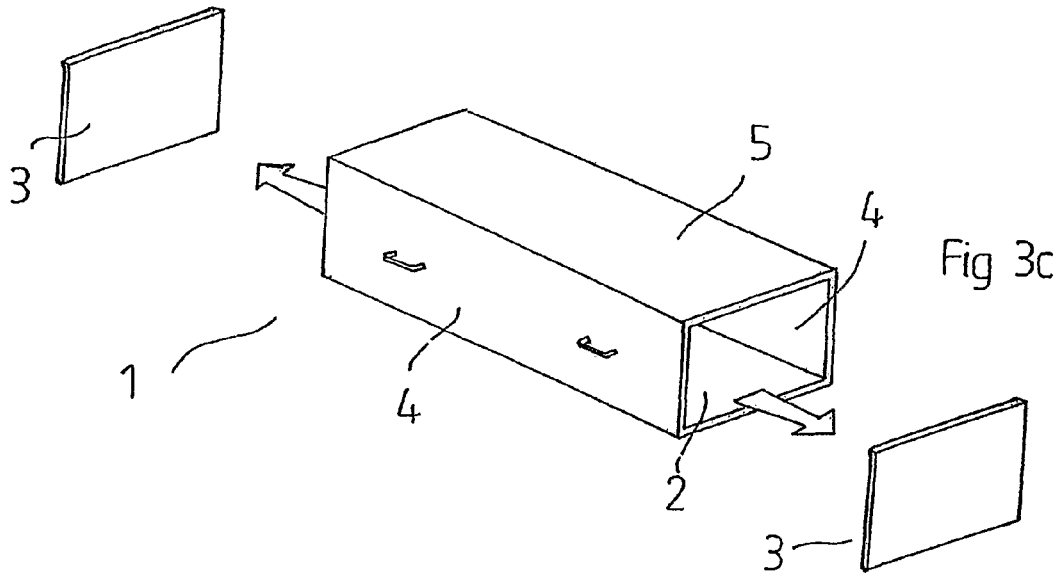

The missing sides 3 or 4 are angled so that the casket 1 is of a hexagonal shape.

n the third variant, shown in FIG. 3, the casket 1 is a parallelepiped.

Figure 5A:
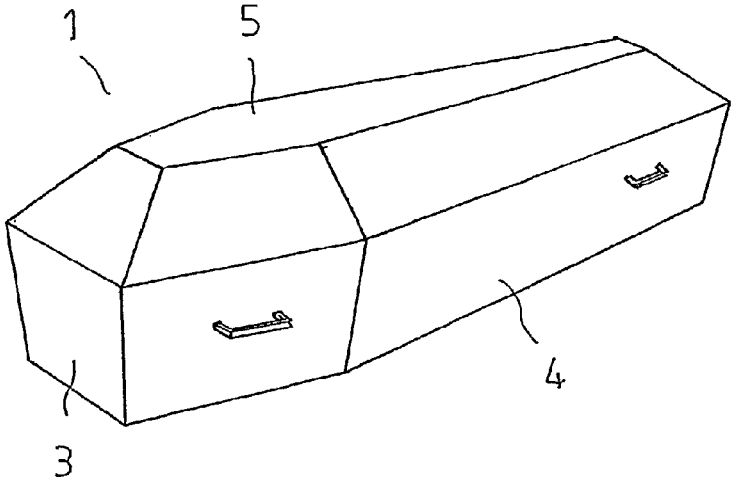
FIGS. 5*a*, 5*b* and 5*c* show perspective views of a fifth variant after closure, and before its two types of closure.
Figure 5B:
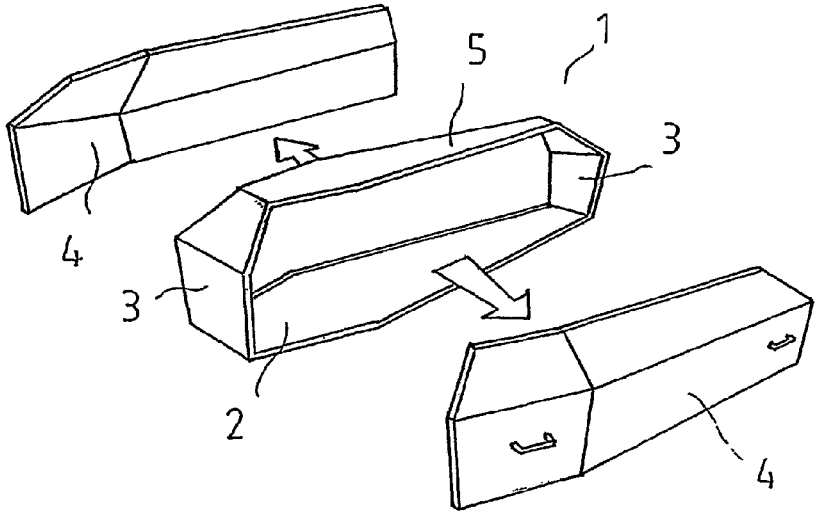

The fourth variant shows a casket 1 in the shape of a tombstone. FIG. 5 show the fifth variant in which the casket is in the shape of a decahedron.

Figure 4A:
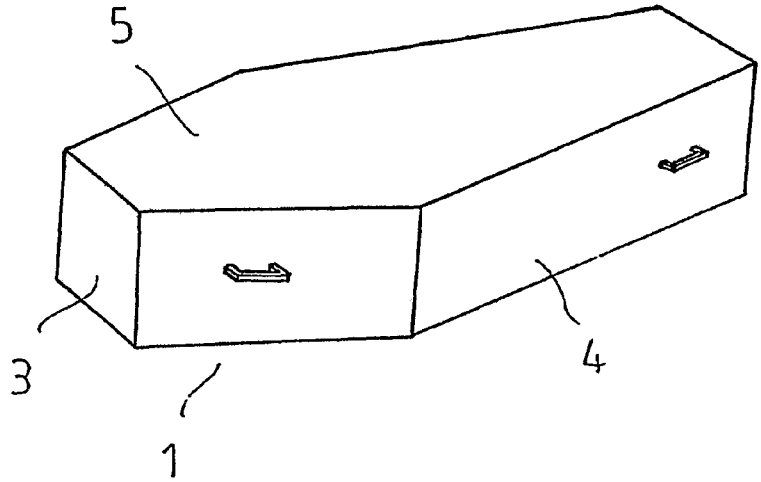
FIGS. 4*a*, 4*b* and 4*c* show perspective views of a fourth variant after closure, and before its two types of closure.
Figure 4B:
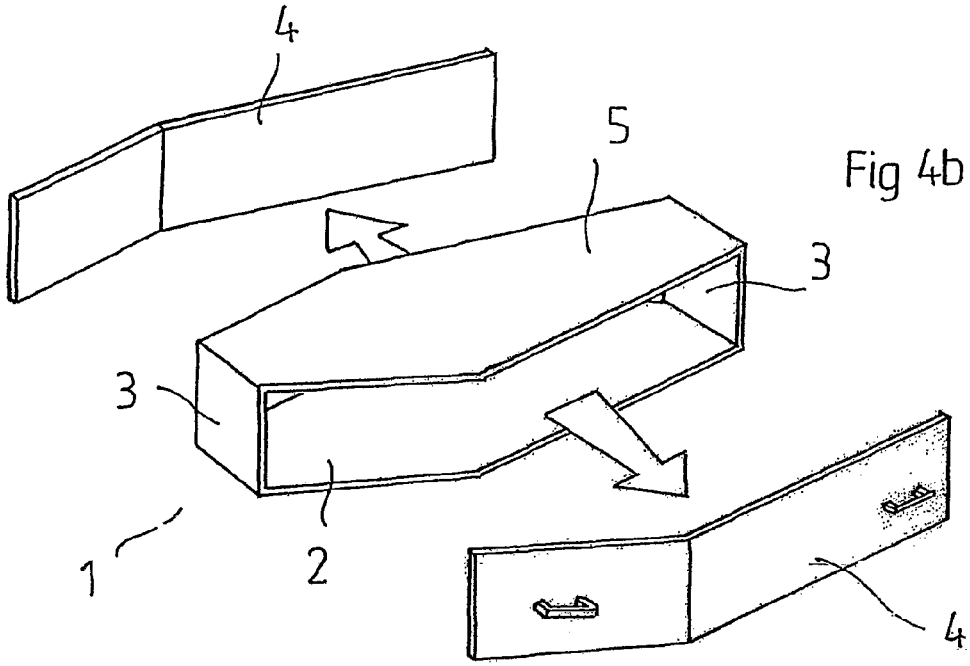
Figure 4C:
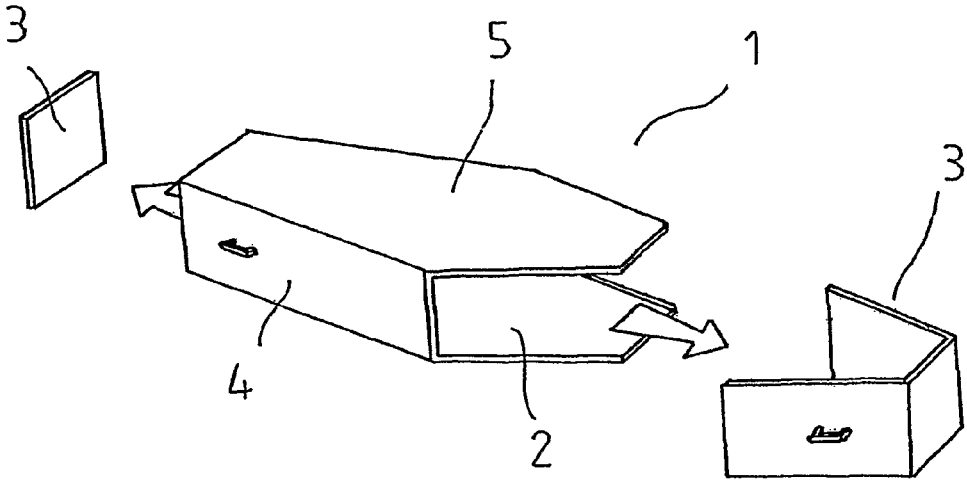
Figure 5C:
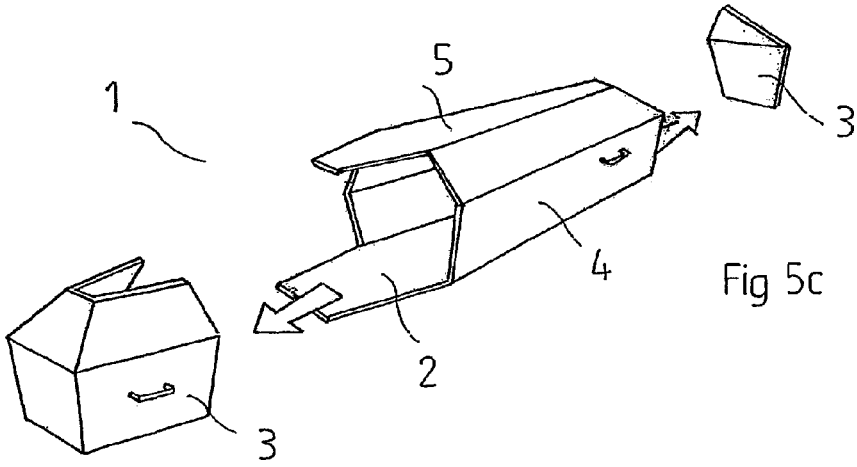
Figure 6:
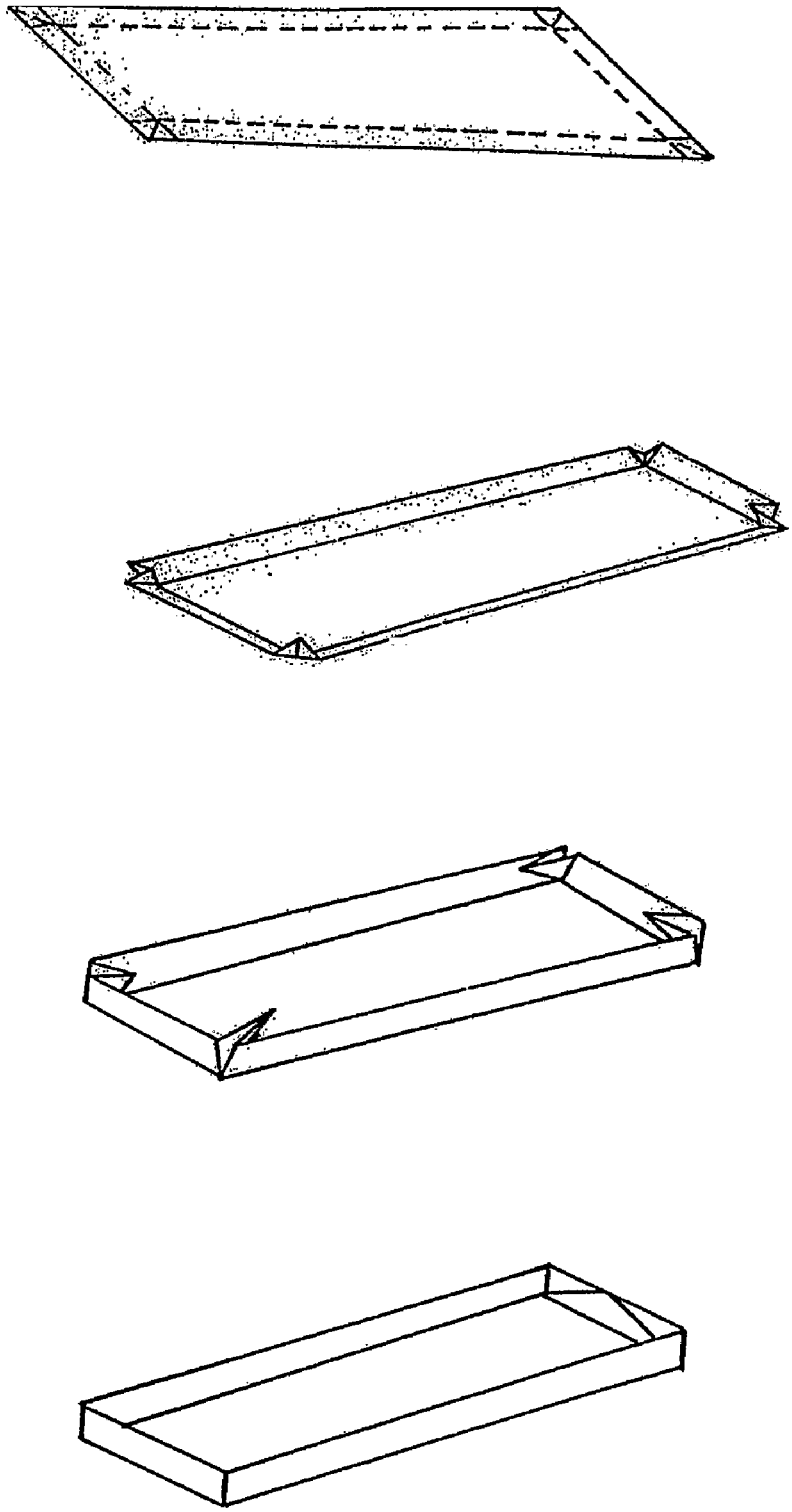
FIG. 6 shows perspective views of the holding tray in different stages of erection.

In these different variants, the sides by which the casket will be closed, namely the transverse sides 3 or the longitudinal sides 4, may be made in one block, as is the case in the third variant (FIGS. 3*a*, 3*b*), in two sections (FIG. 4*b*), in three sections (FIG. 4*c*), in four sections (FIG. 5*b*), or in six sections (FIG. 5*c*).

The transverse 3 or longitudinal 4 sides are secured, when the casket is closed, to the bottom 2 and/or top 5 of the casket. Securing may be done by adhesive, nails, screws or other appropriate means.

The holding tray 6 is also made from a sheet of rigid material, each side of which can be folded up to form a shallow container which will be able to contain any body fluids which may drain down.

In light of the description, it will be understood that the bottom 2 and the top 5 of the casket 1 are formed from a single uninterrupted blank. The body is inserted preferably through one of the transverse sides 3, but insertion through one of the longitudinal sides 4 would not constitute a departure from the scope of the invention.

The casket according to the invention is made from a material stiff enough to support the weight of a body when the casket is lifted. This material may be wood or cardboard. Again, the quality of the material of the casket may vary to suit the destination of the casket, namely cremation or burial.

Various shapes of casket have been described, but the invention is not limited to these types of shapes.

Although the invention has been described with particular embodiments, it encompasses all technical equivalents of the embodiments described.

We claim:

1. A casket assembly comprising:

a single sheet of rigid material being folded as to define a bottom and a top, said top being in spaced relation to said bottom, said single sheet of material further having a pair of transverse sides folded so as to extend respectively between said bottom and said top at opposite ends of said bottom and said top, said pair of transverse sides extending across a width of the casket assembly, said bottom and said top and said pair of transverse sides defining a longitudinal opening;

a holding tray positioned on said bottom and insertable through said longitudinal openings, said holding tray having an open top; and a surface affixed over said longitudinal opening so as to retain said holding tray on said bottom.

2. The casket assembly of claim 1, further comprising:

a lateral reinforcement formed along an edge of said surface and extending substantially along a length of said surface.

3. The casket assembly of claim 1, said surface comprising:

a first single-ply surface foldably connected to an edge of said top; and a second single-ply surface foldably connected to an edge of said bottom, one of said first and second single-ply surfaces overlying the other of said first and second single-ply surfaces.

4. The casket assembly of claim 2, said lateral reinforcement having a tab formed thereon.

5. The casket assembly of claim 1, said surface being affixed by an adhesive.

6. The casket assembly of claim 1, said surface having a handle slot formed therein.

* * * * *